US007328540B1

(12) United States Patent
Rochon

(10) Patent No.: US 7,328,540 B1
(45) Date of Patent: Feb. 12, 2008

(54) AUTOMATED BAGGER AND METHOD

(75) Inventor: Gregory P. Rochon, York, PA (US)

(73) Assignee: Greydon, Inc, York, PA (US)

( * ) Notice: Subject to any disclaimer, the term of this patent is extended or adjusted under 35 U.S.C. 154(b) by 0 days.

(21) Appl. No.: 11/549,167

(22) Filed: Oct. 13, 2006

(51) Int. Cl.
*B65B 43/52* (2006.01)
*B65B 57/04* (2006.01)
*B65B 61/26* (2006.01)

(52) U.S. Cl. ..... 53/64; 53/131.4; 53/571; 53/385.1

(58) Field of Classification Search ..... 53/571
See application file for complete search history.

(56) References Cited

U.S. PATENT DOCUMENTS

| | | | | |
|---|---|---|---|---|
| 3,190,054 | A | 6/1965 | Arnold et al. | 53/131 |
| 3,455,088 | A * | 7/1969 | Lerner | 53/385.1 |
| 3,477,196 | A * | 11/1969 | Lerner | 53/479 |
| 3,765,326 | A | 10/1973 | Hawkins | 101/44 |
| 3,881,410 | A | 5/1975 | Shenoha | 101/41 |
| 3,948,015 | A * | 4/1976 | Lerner | 53/434 |
| 4,037,388 | A * | 7/1977 | Bastasch | 53/64 |
| 4,073,117 | A | 2/1978 | Shenoha | 53/14 |
| 4,073,122 | A | 2/1978 | Areson | 53/131.4 |
| 4,334,399 | A | 6/1982 | Onishi | 53/69 |
| 4,336,681 | A * | 6/1982 | Onishi | 53/459 |
| 4,393,640 | A | 7/1983 | Cole et al. | 53/69 |
| 4,545,184 | A * | 10/1985 | Akiyama | 53/571 |
| 4,859,083 | A | 8/1989 | Nocek et al. | 383/37 |
| 4,903,600 | A | 2/1990 | Long | 101/495 |
| 5,371,521 | A * | 12/1994 | Wehrmann | 347/171 |
| 6,470,648 | B1 | 10/2002 | Baker | 53/411 |
| 6,543,201 | B2 | 4/2003 | Cronauer et al. | 53/131.5 |
| 6,688,346 | B2 | 2/2004 | Brahier et al. | 141/314 |
| 6,837,023 | B1 | 1/2005 | Glatfelter, Jr. | 53/64 |
| 7,062,892 | B2 | 6/2006 | Metzger | 53/440 |
| 7,082,737 | B2 | 8/2006 | Van Fens et al. | 53/64 |
| 7,100,345 | B2 | 9/2006 | Send | 53/51 |
| 2003/0106285 | A1 | 6/2003 | Cronauer et al. | 53/411 |

* cited by examiner

*Primary Examiner*—John Sipos
(74) *Attorney, Agent, or Firm*—Hooker & Habib, P.C.

(57) ABSTRACT

A product bagger and method where products are placed in inflated lead bags on a bag assembly without actuating a sensor for shutting down the bagger.

17 Claims, 2 Drawing Sheets

AUTOMATED BAGGER AND METHOD

FIELD OF THE INVENTION

The invention relates to product baggers of the type in which an indefinite length shingled bag assembly is fed to a workstation where products are placed in lead bags, and to related methods.

BACKGROUND OF THE INVENTION

Foods products, such as meat, cheese and the like, are conventionally packaged in plastic bags using an automated bagger of the type described in U.S. Pat. No. 6,837,023. The bagger feeds empty lead bags mounted on tapes in a shingled bag assembly along a workstation surface. The lead bag in the assembly is inflated and a product is inserted into the bag. The filled bag is then stripped from the bag assembly and sealed and the tape is drawn into a tape slot extending across the workstation surface and wound onto a reel under the workstation. Winding of the tape feeds the next bag in the shingled assembly to the workstation surface, the bag is inflated by an air blast and the cycle is repeated.

When the lead bag is feed along the workstation surface, the leading end of the bag activates a trigger extending above workstation surface adjacent the slot. Trigger activation sends a signal to the bagger to halt feeding the bag assembly. This prevents the bagger from winding unfilled bags attached to the tape around the reel and prevents bag waste.

During high-speed operation of the bagger, a bagger operator will load product into a moving lead bag before the bag activates the trigger. The operator will rapidly load product into the moving lead bag as soon as the bag is inflated and then remove the loaded bag from the workstation to prepare for loading the next bag. The leading ends of the bags do not engage the trigger.

The operator may during high speed loading, accidentally move the product against the trigger as the product is moved into a moving lead bag. Accidental activation of the trigger deactivates the bagger and slows product packing. The operator must wait for the bagger to resume feeding the bag assembly before product packaging can resume.

In the case of baggers that include printers, accidental activation of the trigger will further slow operation of the bagger as the printer must reset before product packaging can resume.

Therefore, there is a need for an automated bagger and method that allow efficient, high-speed loading of moving bags delivered to a workstation without inadvertent deactivation of the bagger. The bagger must shut down when a lead bag is not loaded.

SUMMARY OF THE INVENTION

The invention is an automated bagger and method for improved high-speed bagging. The bagger has a sensor located in the tape slot below the workstation loading surface, out of the path of the product during loading into a bag. Loaded of products cannot stop the bagger.

If the bagger draws a lead bag on the bag assembly from the workstation into the tape slot, the sensor detects the leading end of the bag in the slot and stops the bagger reel from further feeding the bag assembly. The location of the sensor below the loading surface prevents accidental halt of bag feeding during high-speed operation of the bagger.

The invention improves bagging speed and efficiency.

Other objects and features of the invention will become apparent as the description proceeds, especially when taken in conjunction with the accompanying drawings illustrating the invention.

DESCRIPTION OF THE PREFERRED EMBODIMENT

Figure 1:
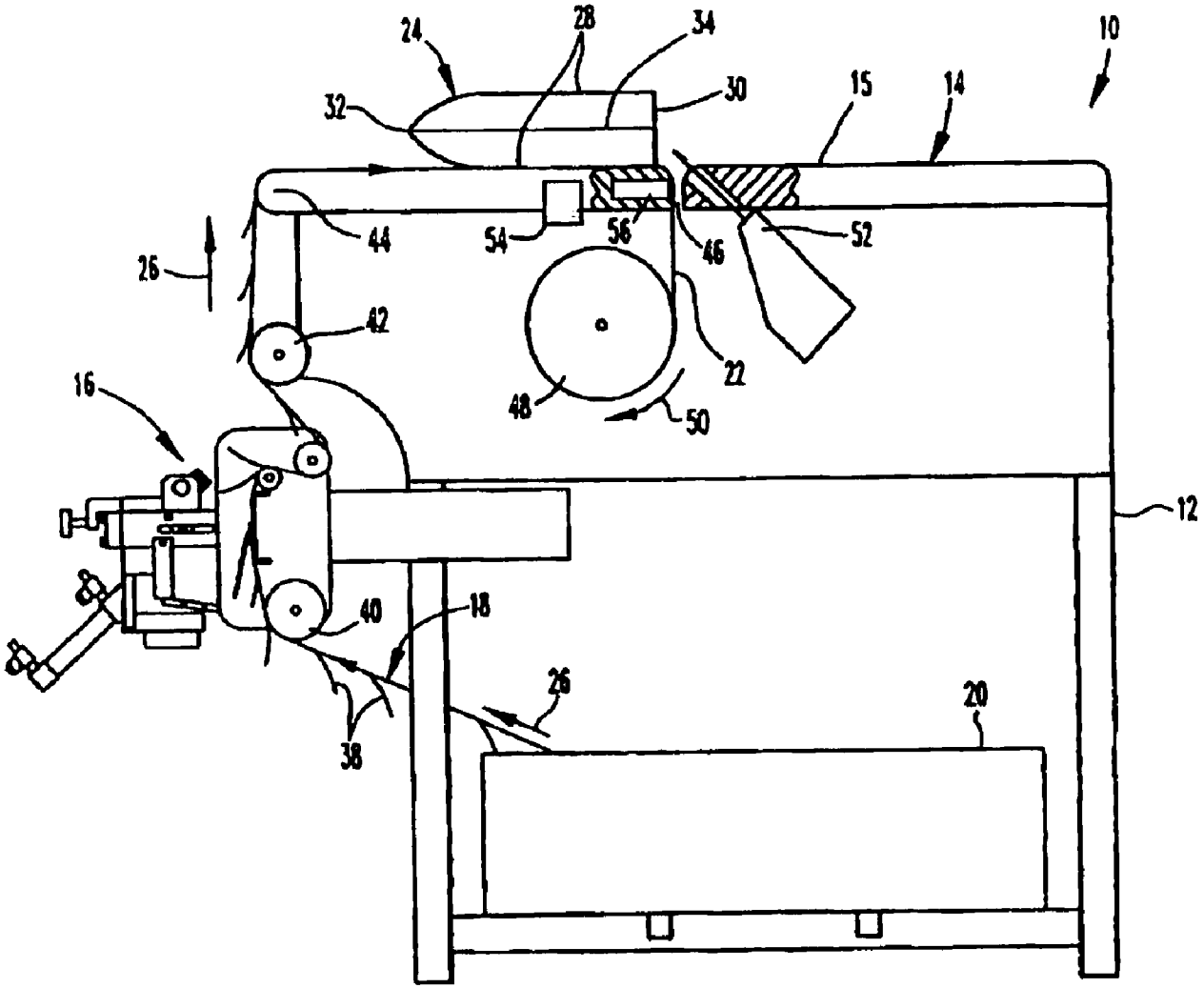
FIG. 1 is a side view of a bagger.

The bagger 10 disclosed herein relates to the bagger of Glatfelter U.S. Pat. No. 6,837,023, the disclosure of which is incorporated herein by reference in its entirety FIG. 1 illustrates bagger 10 having a frame 12, a workstation 14 having a work surface 15 at the top of the frame and an optional bag printer assembly 16 mounted on one side of frame 12. An indefinite length shingled bag assembly 18 is fed from bag assembly source or box 20 mounted on the bottom of frame 12, through printer assembly 16 and onto workstation surface 15. The printer assembly prints desired information, typically date and source information, on each bag in the bag assembly.

Figure 2:
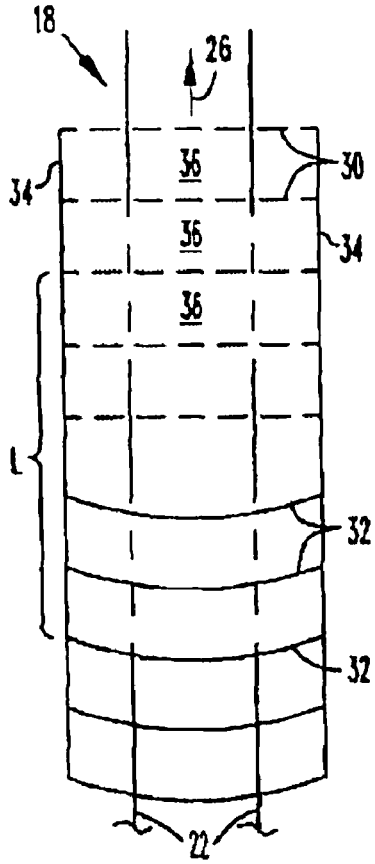
FIG. 2 is a view of overlapped or shingled bags in a bag assembly.

FIG. 2 illustrates a portion of assembly 18. The assembly includes two spaced, parallel indefinite length adhesive elongate members or strips 22. Generally rectangular shingled plastic bags 24 are adhered to strips 22. The assembly 18 is fed from box 20 to station 14 downstream in the direction of arrow 26.

Figure 3:
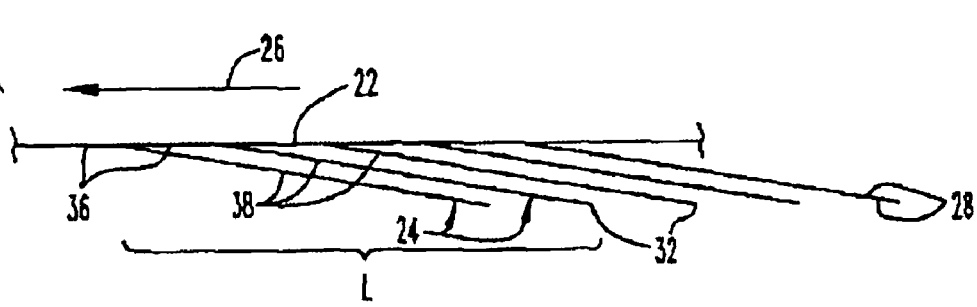
FIG. 3 is a side view of FIG. 2.

Each bag 24 is made from thin plastic film and has opposed rectangular sides 28 (See FIG. 1), an open lead end 30, sealed trailing end 32 and sealed edges 34 extending between ends 30 and 32. Each bag extends a distance L along assembly 18, as measured between ends 30 and 32. FIG. 3 illustrates that a lead portion 36 of each bag side 28 adjacent strips 22 is adhered to the strips to hold the bags in the bag assembly. Portions 36 extend a short distance from lead bag ends 30 toward trailing bag ends 32 and are continuous along the assembly. The trailing portions 38 of the bags are shingled or overlie each other, as shown in FIG. 3, and are not joined to strips 22. The trailing portions 38 may have a length along the assembly considerably greater than the length of adhered lead portions 36.

As shown in FIG. 1, bag assembly 18 is fed from box 20 to printer assembly 16 with strips 22 on the top of the bag assembly and bag upstream trailing portions 38 hanging down from the bottom of the assembly. The bag assembly is fed around lower roller 40, through printer assembly 16, around upper roller 42, around the rounded edge 44 of workstation 14 along and to surface 15 slot 46 extending through the workstation.

Strips 22 extend through the slot 46 and are wound on reel 48. A drive motor (not illustrated) rotates reel 48 in the direction of arrow 50 to feed assembly 18 from box 20, through printer assembly 16 and to station 14.

Bagger 10 includes an air nozzle 52 located below surface 15. The nozzle is connected to a source of compressed air.

During operation of the bagger, the nozzle 52 continuously blows compressed air through an opening in station 14 toward the open lead end of each bag 24. The air blast from nozzle 52 inflates the lead bag, as illustrated in FIG. 1, to permit an operator to insert a product to be packaged within the open bag and then remove the product and bag from strips 22. The bag is then sealed closed. If desired, air in the bag may be removed to vacuum pack the product.

Micro-switch 54 is mounted on workstation 14 and is electrically connected to sensor 56 located in workstation 14 at slot 46 under work surface 15. Sensor 56 may be an optical sensor that faces the slot and detects a bag 24 fed into the slot. As a lead portion 36 of a bag 24 passes in front of sensor 56, the sensor detects the presence of the lead portion and sends a signal to activate switch 54 to stop rotation of reel 48 and further feeding of bag assembly 18 through bagger 10.

The operation of bagger 10 will now be described.

An indefinite length of bag assembly 18 is folded in box 20 so that when a length of the assembly is pulled from the box toward optional printer assembly 16, as illustrated in FIG. 1, adhesive strips 22 are on the upper side of the assembly, and plastic bags 24 are on the lower side of the assembly with the lead bag portions 36 adhered to strips 22 and the shingled trailing bag portions 38 extending rearwardly or upstream along the assembly 18 free from the strips. The lead portions 36 overlap each other along the length of the bag assembly, as illustrated in FIG. 2.

The lead end of the bag assembly is fed around roller 40, and through optional bag printer assembly 16. The lead end is then fed around roller 42, around workstation edge 44, along surface 15 and into slot 46. The bags at the end of the assembly extending past printer assembly 16 are stripped away and the two adhesive strips 22 are attached to reel 48 so that rotation of the reel 48 by the drive motor in the direction of arrow 50 feeds the bag assembly 18 from box 20 past printer assembly 16 and to station 14 in the direction of arrow 26.

The control circuitry for bagger 10 activates the motor to rotate reel 48 and feed bag assembly 18 downstream across surface 15. The air blast from nozzle 52 inflates the moving lead bag as shown in FIG. 1 so that an operator may place a product in the bag and then remove the bag and product from strips 22. Placement of the product in the bag does not trigger sensor 56. The bag is then sealed conventionally. High speed bagging continues with the operator placing products in moving lead bags which are fed continuously along the surface 15 without interruption.

In the event a product is not placed in a lead bag, the bag is fed into slot 46 and triggers sensor 56 to stop feed of the bag assembly. Upon removal of the bag the sensor is deactivated and bag feeding and loading recommence.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention:

1. A bagger for feeding bags to a workstation for loading, the bags arranged in an indefinite length shingled bag assembly with a plurality of shingled bags each having an open lead end, a sealed trailing end, a lead portion, a shingled trailing portion overlapping a trailing bag in the bag assembly, and an elongate member extending along the length of the assembly and removably joined to the lead portion of each bag, the bagger comprising: a bagging workstation defining a work surface; feed means located adjacent the workstation for pulling the bag assembly along a path to the workstation and across the work surface; a control circuit for the feed means, the circuit including a sensor located below the work surface for sensing an empty bag in a position below the work surface and in response stopping the feed means, wherein placement of a product in a moving bag on the work surface does not activate the sensor, and movement of the lead portion of a bag below the work surface actuates the sensor to deactivate said feed means and stop movement of the bag assembly over the work surface.

2. The bagger as in claim 1 including a slot extending across the workstation, the elongate member extending from the work surface through the slot and to the feed means.

3. The bagger as in claim 2 wherein the sensor is located in the slot.

4. The bagger as in claim 1 including a bag printer assembly located on the path upstream from the workstation.

5. A bagger as in claim 1 including an air nozzle aimed to inflate the lead bag.

6. The bagger as in claim 1 including a bag assembly source below the bagging workstation.

7. The bagger as in claim 1 wherein the feed means is below the bagging workstation.

8. The bagger as in claim 1 wherein the feed means comprises a reel and a motor for rotating said reel; wherein the elongate member is wound around said reel.

9. A bagger for feeding bags to a workstation for loading, the bagger comprising:

a bagging workstation, the bagging workstation including a work surface;

an indefinite length shingled bag assembly extending to the bagging workstation and across the work surface, the assembly having a plurality of shingled bags each having an open lead end, a sealed trailing end, a lead portion, a shingled trailing portion overlapping a trailing bag in the bag assembly, and an elongate member extending along the length of the assembly and removably joined to the lead portion of each bag;

feed means located adjacent the workstation for pulling the elongated member below the work surface, to move the lead bags in the bag assembly to the work surface for loading, and a bag sensor located below the work surface for sensing an empty bag in a position below the work surface and in response stopping the feed means wherein loading of moving lead bags on the work surface does not actuate the sensor and feeding of a lead bag below the work surface actuates the sensor to deactivate the feed means and stop movement of the bag assembly across the work surface.

10. The bagger as in claim 9 including a slot in workstation, the elongate member extending through the slot.

11. The bagger as in claim 10 wherein the sensor is located in the slot.

12. The bagger as in claim 11 including a bag assembly source located below the workstation.

13. The bagger as in claim 11 wherein the feed means is below the bagging workstation.

14. The bagger as in claim 9 wherein the feed means comprises a reel and a motor for rotating said reel; wherein the elongate member is wound onto said reel.

15. The method of loading products in lead bags of an indefinite length bag assembly where each bag has an open downstream end, a closed upstream end, a lead portion adhered to the assembly and a shingled trailing portion overlying an upstream bag, comprising the steps of:

A) feeding the bag assembly across a work surface;

B) inflating the lead bag in the assembly at the work surface;

C) for each bag in the bag assembly, either loading a product into the bag as it moves across the work surface and removing the loaded bag from the assembly, or feeding the empty bag below the work surface; and D) sensing movement of an empty bag to a position below the work surface and then halting feeding of the bag assembly across the work surface until the bag is removed and when loading a product into the bag not halting the feeding of the bag assembly across the work surface.

16. The method of claim 15 including the steps of:

E) removing the bag extended into the slot; and

F) resuming the feeding of the bag assembly across the work surface.

17. The method of claim 16 including the step of:

G) inflating a bag located on the work surface with a stream of air.

* * * * *